US006540160B2

(12) United States Patent
Rodriguez-Amaya et al.

(10) Patent No.: US 6,540,160 B2
(45) Date of Patent: Apr. 1, 2003

(54) FUEL INJECTION DEVICE FOR AN INTERNAL COMBUSTION ENGINE

(75) Inventors: Nestor Rodriguez-Amaya, Stuttgart (DE); Roger Potschin, Brackenheim (DE); Ulrich Gruen, Ditzingen (DE); Ulrich Projahn, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/147,084

(22) Filed: May 17, 2002

(65) Prior Publication Data

US 2003/0010846 A1 Jan. 16, 2003

(30) Foreign Application Priority Data

May 17, 2001 (DE) ..... 101 23 995

(51) Int. Cl.[7] ..... F02M 47/02

(52) U.S. Cl. ..... 239/533.2; 123/445; 123/446; 123/448; 123/305; 239/533.1; 239/533.3; 239/533.5

(58) Field of Search ..... 239/533.1, 533.2, 239/533.3, 533.5; 123/448, 446, 305, 457, 445

(56) References Cited

U.S. PATENT DOCUMENTS 4,951,631 A * 8/1990 Eckert ..... 123/446

5,823,161 A * 10/1998 Potz et al. ..... 123/305

FOREIGN PATENT DOCUMENTS

EP 09575261 A1 * 11/1999 ..... F02M/47/02

* cited by examiner

*Primary Examiner*—Steven O. Douglas
*Assistant Examiner*—Azy Kokabi
(74) *Attorney, Agent, or Firm*—Ronald E. Greigg

(57) ABSTRACT

A fuel injection device having a fuel pump for each cylinder of an internal combustion engine, which fuel pump has a pump piston that is driven into a stroke motion by the engine and delimits a pump working chamber, which is supplied with fuel from a fuel tank and is connected to a fuel injection valve, which has an injection valve member that controls at least one injection opening and can be moved by the pressure generated in the pump working chamber in an opening direction counter to a closing force. A first electrically controlled control valve controls a connection of the pump working chamber to a discharge chamber, and a second electrically controlled control valve controls the pressure prevailing in a control pressure chamber of the fuel injection valve, which pressure acts on the injection valve member in the closing direction. A third electrically controlled control valve controls an additional connection of the pump working chamber to the discharge chamber; this connection contains a pressure control valve that opens toward the discharge chamber.

6 Claims, 2 Drawing Sheets

FUEL INJECTION DEVICE FOR AN INTERNAL COMBUSTION ENGINE

BACKGROUND OF THE INVENTION

1. Field of the Invention

The invention is directed to an improved fuel injection device for an internal combustion engine and having a fuel pump for each cylinder of the engine.

2. Description of the Prior Art

A fuel injection device of this kind has been disclosed by EP 0 957 261 A1. For each cylinder of the engine, this fuel injection device has a fuel pump that has a pump piston that is driven into a stroke motion by the engine and delimits a pump working chamber to which fuel is supplied from a fuel tank. The pump working chamber is connected to a fuel injection valve that has an injection valve member, which controls at least one injection opening and can be moved in the opening direction, counter to a closing force, by the pressure prevailing in a pressure chamber connected to the pump working chamber. A first electrically controlled control valve is provided, which controls a connection of the pump working chamber to the fuel tank, which functions as a discharge chamber. A second electrically controlled control valve is also provided, which controls the control pressure prevailing in a control pressure chamber, which pressure acts at least indirectly on the injection valve member in the closing direction. In this known fuel injection device, it is disadvantageous that a fuel injection can only be carried out in accordance with the pressure level produced by the fuel pump.

OBJECT AND SUMMARY OF THE INVENTION

The fuel injection device according to the invention has the advantage over the prior art that the third control valve and the pressure control valve permit a preinjection and a beginning of a main injection at a reduced pressure level, which can reduce the emissions and noise of the engine.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
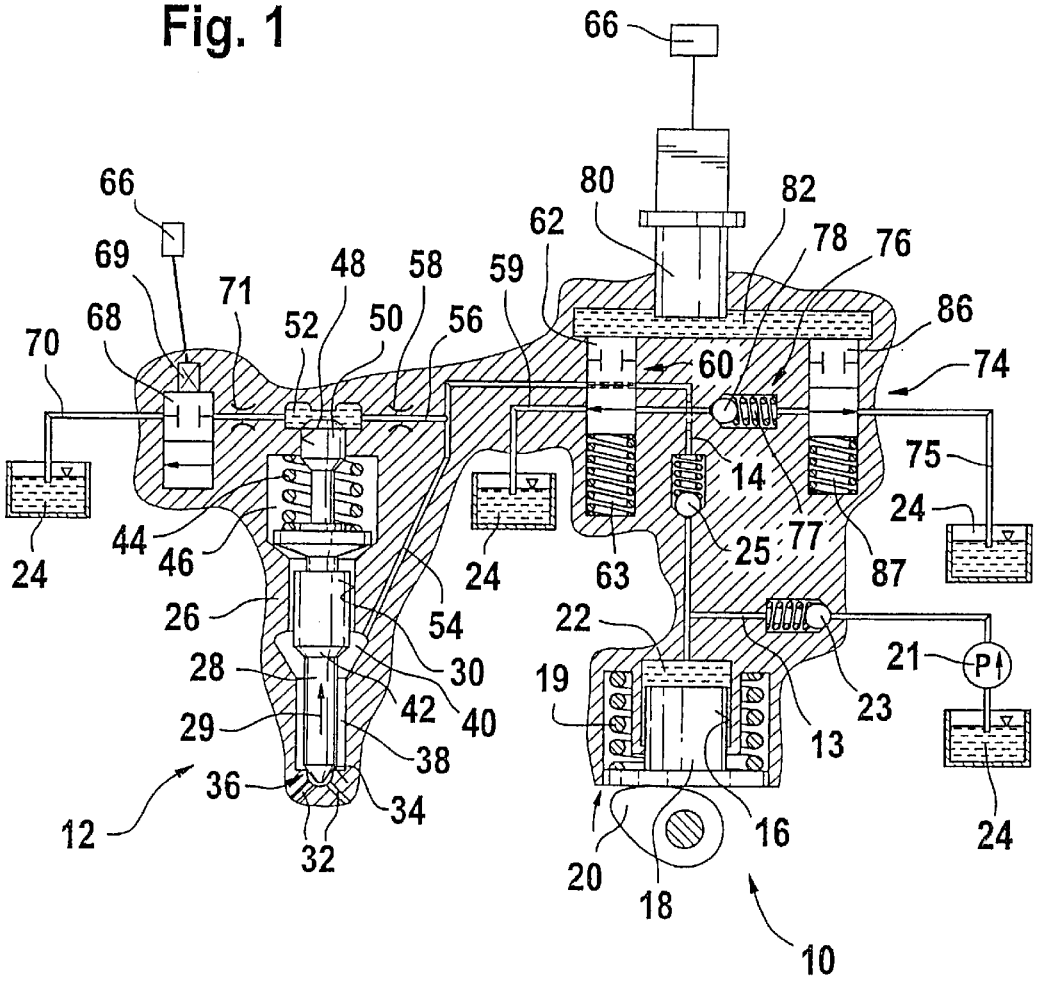
FIG. 1 is a schematic depiction of a first embodiment of a fuel injection device for an internal combustion engine.
Figure 3:
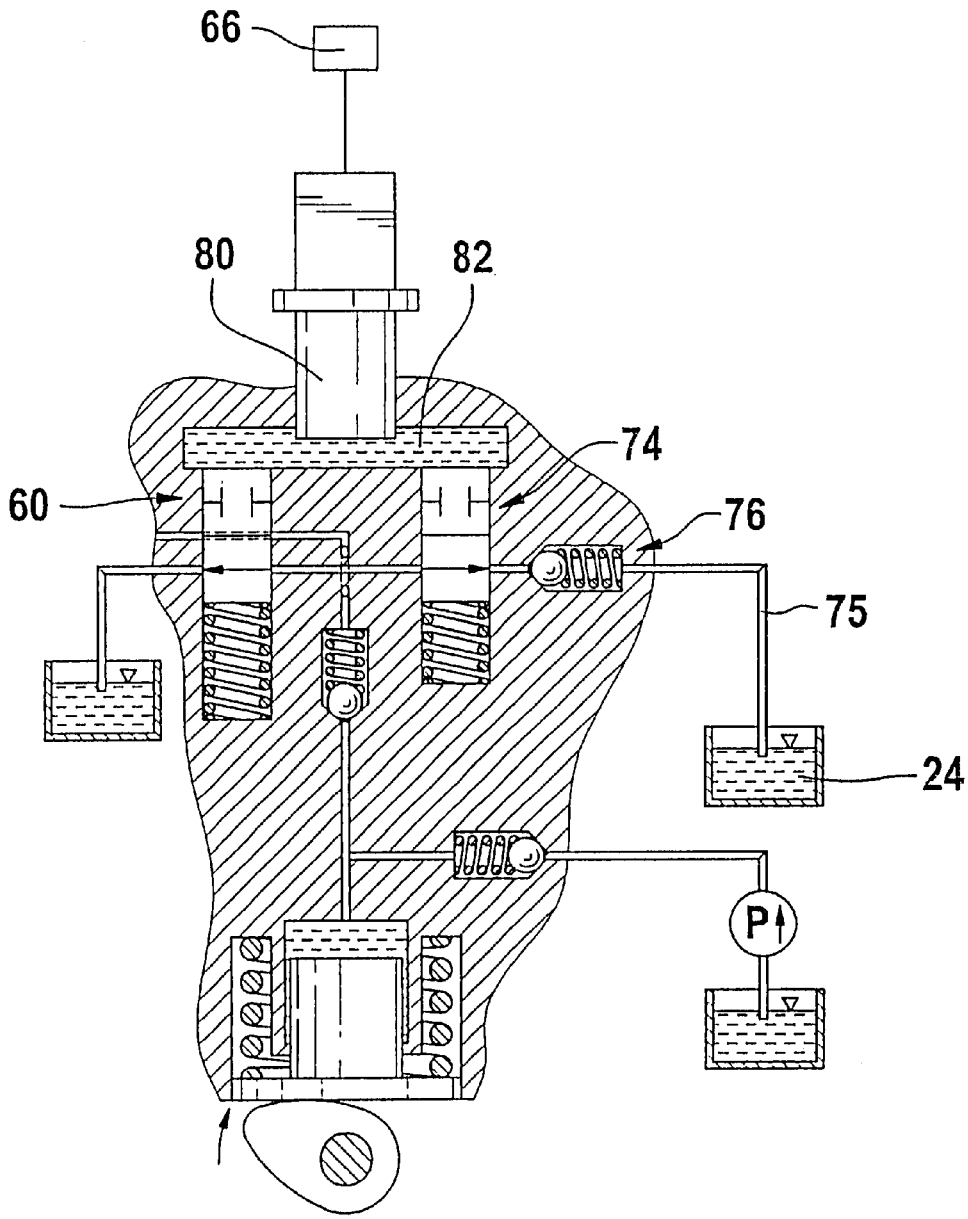
FIG. 3 shows a detail of a modified embodiment of the fuel injection device.

FIGS. 1 and 3 show a fuel injection device for an internal combustion engine of a motor vehicle. Preferably, the engine is a compression-ignition motor. The fuel injection device is preferably embodied as a so-called unit pump system and, for each cylinder of the engine, has a respective fuel pump 10, a fuel injection valve 12, and a line 14 that connects the fuel injection valve 12 to the fuel pump 10. The fuel pump 10 has a pump piston 18 that is guided in a sealed fashion in a cylinder 16 and is driven into a stroke motion counter to the force of a restoring spring 19 by a cam 20 of a camshaft of the engine. In the cylinder 16, the pump piston

18 delimits a pump working chamber 22 in which fuel is compressed at high pressure during the delivery stroke of the pump piston 18. The pump working chamber 22 is supplied with fuel from a fuel tank 24 of the motor vehicle by means of a fuel-supply pump 21. A check valve 23 that opens toward the pump working chamber 22 is situated between the fuel-supply pump 21 and the pump working chamber 22. The line 14 can contain an additional check valve 25, which opens out from the pump working chamber 22. The supply line 13 from the fuel-supply pump 21 is connected to a point between the pump working chamber 22 and the additional check valve 25.

The fuel injection valve 12 is separate from the fuel pump 10 and is connected to the pump working chamber 22 via the line 14. The fuel injection valve 12 has a valve body 26, which can be comprised of multiple parts, in which an injection valve member 28 is guided so that it can move longitudinally in a bore 30. In its end region oriented toward the combustion chamber of the engine cylinder, the valve body 26 has at least one, preferably several, injection openings 32. In its end region oriented toward the combustion chamber, the injection valve member 28 has a sealing surface 34 that is approximately conical in shape, for example, and cooperates with a valve seat 36, which is embodied in the valve body 26 in its end region oriented toward the combustion chamber, and the injection openings 32 lead from this valve seat 36 or from a point downstream of it. At its end toward the valve seat 36, the valve body 26 contains an annular chamber 38 between the injection valve member 28 and the bore 30, and in its end region oriented away from the valve seat 36, this annular chamber 38 transitions via a radial enlargement of the bore 30 into a pressure chamber 40 that encompasses the injection valve member 28. The injection valve member 28 has a pressure shoulder 42 formed by a cross sectional reduction at the height of the pressure chamber 40. The end of the injection valve member 28 oriented away from the combustion chamber is engaged by a prestressed closing spring 44, which pushes the injection valve member 28 toward the valve seat 36. The closing spring 44 is disposed in a spring chamber 46 of the valve body 26, which adjoins the bore 30. At its end oriented away from the bore 30, the spring chamber 46 adjoins another bore 48 in the valve body 26, in which bore a piston 50 is guided in a sealed fashion, which is connected to the injection valve member 28. With its end oriented away from the injection valve member 28, the piston 50 delimits a control pressure chamber 52 in the valve body 26. The valve body 26 contains a conduit 54, which is fed by the line 14 to the fuel pump 10 and feeds into the pressure chamber 40.

A connection 56 to the control pressure chamber 52 branches from the conduit 54 of the fuel injection valve 12. The fuel injection device has a first control valve 60, which is situated close to the fuel pump 10 and can, for example, be integrated into the fuel pump 10. The first control valve 60 controls a connection 59 of the pump working chamber 22 of the fuel pump 10 to a discharge chamber, which function can be fulfilled at least indirectly by the fuel tank 24. The connection 59 branches from the line 14 downstream of the check valve 25.

The first control valve 60 can be embodied as pressure-compensated or non-pressure-compensated. The first control valve 60 is embodied as a 2/2-port directional-control valve that opens the connection 59 to the discharge chamber 24 in a first switching position and closes the connection 59 to the discharge chamber 24 in a second switching position.

In order to control the pressure in the control pressure chamber 52, a second control valve 68 is provided, which controls a connection 70 of the control pressure chamber 52 to a discharge chamber, for example the fuel tank 24. The second control valve 68 can be electrically controlled and has an actuator 69, which can be an electromagnet or a piezoelectric actuator, which is electrically activated by a control unit 66 and can move a valve member of the control valve 68. The second control valve 68 is preferably embodied as pressure-compensated. The second control valve 68 is embodied as a 2/2-port directional-control valve that closes the connection 70 of the control pressure chamber 52 to the fuel tank 24 in a first switching position and opens the connection 70 of the control pressure chamber 52 to the fuel tank 24 in a second switching position. A throttle restriction 58 is provided in the connection 59 of the control pressure chamber 52 to the line 14 and another throttle restriction 71 is provided in the connection 70 of the control pressure chamber 52 to the fuel tank 24, between the control pressure chamber 52 and the second control valve 68. The control unit 66 likewise controls the second control valve 68. The control unit 66 controls the control valves 60, 68 as a function of operating parameters of the engine, such as speed, load, and temperature.

A third control valve 74 is also provided, which controls an additional connection 75 of the pump working chamber 22 to a discharge chamber, which function can once again be fulfilled by the fuel tank 24. The connection 75 contains a pressure control valve 76 that opens in the direction of the fuel tank 24. For example, the pressure control valve 76 has a valve member 78, which is loaded by a closing spring 77 and can be moved toward the fuel tank 24 in the opening direction, counter to the force of the closing spring 77. The pressure control valve 76 is preferably disposed, as shown in FIG. 1, upstream of the third control valve 74; in this case, the third control valve 74 does not need to be pressure-compensated. However, the pressure control valve 76 can also be disposed, as shown in FIG. 3, downstream of the third control valve 74; in that case, the third control valve 74 is then preferably embodied as pressure-compensated. The third control valve 74 is embodied as a 2/2-port directional-control valve that opens the connection 75 to the discharge chamber 24 in a first switching position and closes the connection 75 to the discharge chamber 24 in a second switching position.

A shared actuator 80 that is electrically activated by the control unit 66 preferably controls the first control valve 60 and the third control valve 74. The first control valve 60 and the third control valve 74 can be situated in the fuel pump 10. The control valves 60, 74 can, for example, be placed next to each other. The actuator 80 controls the pressure prevailing in an actuator pressure chamber 82; the actuator pressure chamber 82 is filled with a hydraulic fluid, in particular fuel. The actuator 80 is preferably embodied as a piezoelectric actuator, which changes in length depending on an electrical voltage that is applied to it. The two control valves 60, 74 each have a control valve member 62, 86, which is acted on by the pressure in the actuator pressure chamber 82 and can be moved counter to the force of a restoring spring 63, 87. The prestressing of the restoring spring 87 of the third control valve 74 is greater than the prestressing of the restoring spring 63 of the first control valve 60. When the pressure in the actuator pressure chamber 82 is low, the first control valve 60 and the third control valve 74 are open so that both connections 59 and 75 of the pump working chamber 22 to the discharge chamber 24 are open. If the pressure in the actuator pressure chamber 82 is increased to a first pressure level through corresponding activation of the actuator 80 by means of the control unit 66, then the first control valve 60, due to the lower prestressing of its restoring spring 63, is switched into its closed position so that the connection 59 of the pump working chamber 22 to the discharge chamber 24 is closed. At this pressure level, though, the third control valve 74 remains in its open position due to the higher prestressing of its restoring spring 87 so that when the pressure set by the pressure control valve 76 is exceeded, the pump working chamber 22 is connected to the discharge chamber 24 via the open connection 75. Only when the pressure in the actuator pressure chamber 82 is increased further to a second pressure level through a corresponding activation of the actuator 80 by the control unit 66 does the third control valve 74 switch into its closed position so that the pump working chamber 22 is completely shut off from the discharge chamber 24. The first control valve 60 remains in its closed position when the pressure in the actuator pressure chamber 82 increases.

The function of the fuel injection device will be explained below. During the intake stroke of the pump piston 18, the fuel-supply pump 21 supplies fuel from the fuel tank 24 to the pump working chamber 22 through the open check valve 23 via the line 13. During the delivery stroke of the pump piston 18, the check valve 23 closes and the check valve 25 opens; the first control valve 60 is open, so that the connection 59 to the discharge chamber 24 is open. The fuel injection begins with a preinjection in which the first control valve 60 is closed by virtue of the fact that the control unit 66 activates the actuator 80 in such a way that the pressure in the actuator pressure chamber 82 increases to the first pressure level and the first control valve 60 switches into its closed position, closing the connection 59 to the discharge chamber 24. The third control valve 74 remains in its open position. Consequently, only the pressure that is set by the pressure control valve 76 can build up in the pump working chamber 22, the line 14, and the pressure chamber 40 of the fuel injection valve 12. When the pressure set by the pressure control valve 76 is exceeded, then the pressure control valve 76 opens and fuel flows through the open third control valve 74 and the connection 75, into the discharge chamber 24. Subsequently, the pressure prevailing in the line 14 and the pressure chamber 40 remains at least almost constant. The opening pressure of the pressure control valve 76 is determined by the prestressing of its closing spring 77. The preinjection is executed at a pressure that is limited by the pressure control valve 76. The second control valve 68 is opened by a corresponding activation of the actuator 69 so that the control pressure chamber 52 is connected to the discharge chamber 24. Because of the open second control valve 68, increased pressure cannot build up in the control pressure chamber 52, despite its connection 56 to the line 14, but rather, this pressure fluid is discharged into the fuel tank 24. The throttle restrictions 58 and 71 achieve the fact that only a small quantity of fuel can escape from the conduit 54 into the fuel tank 24. When the pressure prevailing in the pressure chamber 40 has reached such a level that it exerts a force acting in the opening direction 29 on the injection valve member 28 via the pressure shoulder 42, which is greater than the force of the closing spring 44 and the force exerted on the piston 50 by the residual pressure prevailing in the control pressure chamber 52, then the injection valve member 28 lifts its sealing surface 34 up from the valve seat 36 and fuel is injected through the injection openings 32 into the combustion chamber of the engine cylinder. Because of the open second control valve 68, the opening pressure of the fuel injection valve 12 is only a function of the force of the closing spring 44 and the force exerted on the piston 50 by the residual pressure prevailing in the control pressure chamber 52.

Figure 2:
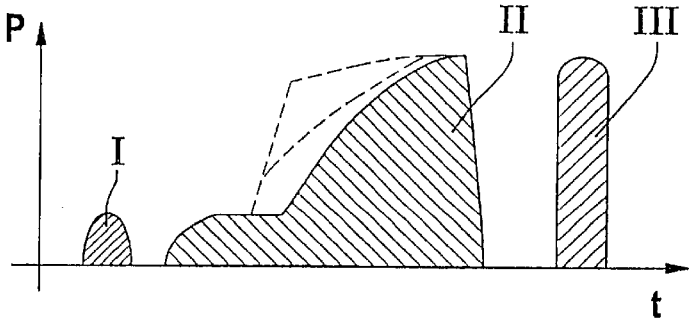
FIG. 2 shows a march of a pressure at injection openings of a fuel injection valve of the fuel injection device.

FIG. 2 shows the march of the pressure p at the injection openings 32 of the fuel injection valve 12 over time t during an injection cycle. The preinjection corresponds to an injection phase labeled I in FIG. 2.

In order to terminate the preinjection, the control unit 66 closes the second control valve 68 so that the control pressure chamber 52 is shut off from the fuel tank 24 and an increased pressure builds up in the control pressure chamber 52 via its connection 56 to the line 14. This causes the piston 50 to exert a force on the injection valve member 28, which works in concert with the force of the closing spring 44, so that the injection valve member 28 moves counter to its opening direction 29 and its sealing surface 34 comes into contact with the valve seat 36, terminating the preinjection. Alternatively or in addition, in order to terminate the preinjection, the first control valve 60 can also be opened so that high pressure can no longer build up in the pump working chamber 22, the line 14, and the pressure chamber 40 so that the force of the closing spring 44 closes the fuel injection valve 12.

For a subsequent main injection, the control unit 66 opens the second control valve 68 so that the control pressure chamber 52 is once again pressure relieved and the fuel injection valve 12 opens. The control unit 66 closes the first control valve 60 so that the connection 59 of the pump working chamber 22 to the discharge chamber 24 is closed. At the beginning of the main injection, the third control valve 74 remains open so that the connection 75 to the discharge chamber 24 is open and the pressure preset by the pressure control valve 76 builds up in the line 14 and the pressure chamber 40 of the fuel injection valve 12. The main injection then begins at the same pressure level at which the preinjection is executed. When the third control valve 74 is closed, the main injection begins at a higher pressure level than when the third control valve 74 is initially open. Then, the control unit 66 closes the third control valve 74 so that the connection 75 to the discharge chamber 24 is closed and the main injection continues at a pressure in the pump working chamber 22, which is generated in accordance with the profile of the cam 20. It is also possible for the third control valve 74 to be closed at first, but for the second control valve 68 to remain closed so that no injection occurs as yet. The second control valve 68 is then opened only after a delay, which delays the beginning of the main injection and also causes this main injection to begin at a higher pressure. The main injection corresponds to an injection phase labeled II in FIG. 2, where the march of pressure depicted with a solid line is for the case in which the third control valve 74 is open at the beginning, and the march of pressure depicted with the dashed line is for the case in which the third control valve 74 is closed just at the beginning.

In order to terminate the main injection, the control unit 66 closes the second control valve 68 so that the control pressure chamber 52 is shut off from the fuel tank 24 and high pressure builds up in the control pressure chamber 52 by means of its connection to the line 14 and thereby to the pump working chamber 22, thus closing the fuel injection valve 12. The first control valve 60 and the third control valve 74 remain closed so that the connections 59 and 75 to the discharge chamber 24 are closed. For a secondary injection, the control unit 66 opens the second control valve 68 again so that the control pressure chamber 52 is once again pressure relieved and the fuel injection valve 12 opens. The secondary injection occurs with a march of pressure that corresponds to the profile of the cam 20. In order to terminate the secondary injection, the control unit 66 closes the second control valve 68 and/or the control unit 66 opens the first control valve 60. The secondary injection corresponds to an injection phase labeled III in FIG. 2.

The foregoing relates to preferred exemplary embodiments of the invention, it being understood that other variants and embodiments thereof are possible within the spirit and scope of the invention, the latter being defined by the appended claims.

We claim:

1. A fuel injection device for internal combustion engines, comprising a fuel pump (10) for each cylinder of the engine, which fuel pump (10) has a pump piston (18) that is driven in a stroke motion by the engine and delimits a pump working chamber (22), which is supplied with fuel from a fuel tank (24)

a fuel injection valve (12) connected to the fuel pump (10), the fuel injection valve (12) having an injection valve member (28) that controls at least one injection opening (32) and can be moved by the pressure prevailing in a pressure chamber (40) connected to the pump working chamber (22) in an opening direction (29) counter to a closing force, a first electrically controlled control valve (60) that controls a connection (59) of the pump working chamber (22) to a discharge chamber (24), a second electrically controlled control valve (68) that controls the pressure prevailing in a control pressure chamber (52) of the fuel injection valve (12), which pressure acts at least indirectly on the injection valve member (28) in the closing direction, and a third electrically controlled control valve (74) which controls a connection (75) of the pump working chamber (22) to a discharge chamber (24), the connection (75) containing a pressure control valve (76) that opens toward the discharge chamber (24).

2. The fuel injection device according to claim 1, wherein that the first control valve (60) and the third control valve (74) are controlled by a shared electrically activated actuator (80).

3. The fuel injection device according to claim 2, wherein the actuator (80) controls the pressure prevailing in a actuator pressure chamber (82), which pressure acts on the first control valve (60) and the third control valve (74).

4. The fuel injection device according to claim 1, wherein the pressure control valve (76) is situated in the connection (75) upstream of the third control valve (74).

5. The fuel injection device according to claim 2, wherein the pressure control valve (76) is situated in the connection (75) upstream of the third control valve (74).

6. The fuel injection device according to claim 3, wherein the pressure control valve (76) is situated in the connection (75) upstream of the third control valve (74).

* * * * *

UNITED STATES PATENT AND TRADEMARK OFFICE

CERTIFICATE OF CORRECTION

PATENT NO. : 6,540,160 B2
DATED : April 1, 2003
INVENTOR(S) : Nestor Rodriguez-Amaya et al It is certified that error appears in the above-identified patent and that said Letters Patent is hereby corrected as shown below:

Title page,
Please correct item [75] to read as follows:
-- Inventors: Nestor Rodriguez-Amaya, Stuttgart (DE);
Roger Potschin, Brackenheim (DE);
Jurgen Gruen, Ditzingen (DE);
Ulrich Projahn, Leonberg (DE) --

Signed and Sealed this

Twenty-ninth Day of July, 2003

JAMES E. ROGAN
*Director of the United States Patent and Trademark Office*